US007189066B2

(12) United States Patent
Liepert

(10) Patent No.: US 7,189,066 B2
(45) Date of Patent: Mar. 13, 2007

(54) LIGHT GAS VACUUM PUMPING SYSTEM

(75) Inventor: Anthony G. Liepert, Lincoln, MA (US)

(73) Assignee: Varian, Inc., Palo Alto, CA (US)

( * ) Notice: Subject to any disclaimer, the term of this patent is extended or adjusted under 35 U.S.C. 154(b) by 110 days.

(21) Appl. No.: 10/845,991

(22) Filed: May 14, 2004

(65) Prior Publication Data

US 2005/0254981 A1 Nov. 17, 2005

(51) Int. Cl.
*F01C 1/30* (2006.01)
*F03C 2/00* (2006.01)
*F04C 2/00* (2006.01)

(52) U.S. Cl. ..... 418/5; 418/55.1; 418/55.2; 418/201.1; 73/40.7; 73/49.2

(58) Field of Classification Search ..... 418/5, 418/55.2, 201.1, 55.1; 73/40, 40.7, 49.2
See application file for complete search history.

(56) References Cited

U.S. PATENT DOCUMENTS 4,499,752 A 2/1985 Fruzzetti et al.
4,735,084 A 4/1988 Fruzzetti
5,537,857 A * 7/1996 Grosse Bley ..... 73/40.7
5,542,828 A 8/1996 Grenci et al.
5,708,194 A * 1/1998 Bohm et al. ..... 73/40.7
5,821,404 A * 10/1998 Bohm et al. ..... 73/40.7
6,021,663 A * 2/2000 Bohm ..... 73/40.7

FOREIGN PATENT DOCUMENTS

EP 0 730 093 A1 9/1996
EP 1 101 942 A2 5/2001
WO WO 03/023229 A1 2/2003

* cited by examiner

*Primary Examiner*—Theresa Trieu
(74) *Attorney, Agent, or Firm*—Bella Fishman

(57) ABSTRACT

A vacuum pumping system includes a primary vacuum pump having an inlet for coupling to a system, and a secondary vacuum pump having an inlet coupled to the exhaust of the primary vacuum pump. The primary vacuum pump is an oil-free, positive displacement vacuum pump having multiple clearance seals between the inlet and the exhaust. The primary vacuum pump may be a scroll vacuum pump, and the secondary vacuum pump may be an oil-free diaphragm pump. The system may include a valve coupled to the exhaust of the primary vacuum pump and configured to couple the exhaust of the primary vacuum pump to an interpump exhaust in response to a selected condition, such as the pressure level at the exhaust of the primary vacuum pump.

16 Claims, 3 Drawing Sheets

LIGHT GAS VACUUM PUMPING SYSTEM

FIELD OF THE INVENTION

This invention relates to vacuum pumping systems and methods and, more particularly, to vacuum pumping systems and methods which have a high compression ratio for light gases, such as helium and hydrogen.

BACKGROUND OF THE INVENTION

Helium mass spectrometer leak detection is a well-known leak detection technique. Helium is used as a tracer gas which passes through the smallest of leaks in a sealed test piece. The helium is then drawn into a leak detection instrument and is measured. The quantity of helium corresponds to the leak rate. An important component of the instrument is a mass spectrometer tube which detects and measures the helium. The input gas is ionized and mass analyzed by the spectrometer tube in order to separate the helium component, which is then measured. In one approach, the interior of a test piece is coupled to the test port of the leak detector. Helium is sprayed onto the exterior of the test piece, is drawn inside through a leak and is measured by the leak detector.

One requirement of the spectrometer tube is that the inlet through which the helium and other gases are received be maintained at a relatively low pressure, typically below $2\times10^{-4}$ Torr. Thus, leak detectors typically include a vacuum pumping system, which may include a roughing pump, a diffusion pump or turbomolecular pump and associated forepump, and a cold trap. Vacuum pumping systems for helium mass spectrometer leak detectors are described, for example, in U.S. Pat. No. 4,499,752, issued Feb. 19, 1985 to Fruzzetti et al. and U.S. Pat. No. 4,735,084, issued Apr. 5, 1988 to Fruzzetti.

A problem with helium mass spectrometer leak detectors is that the vacuum pumping system used to maintain the input of the spectrometer tube at the required pressure may have a low compression ratio for light gases, such as helium. As a result, helium in the ambient environment can move through the vacuum pumping system in reverse direction and be measured by the mass spectrometer. The helium that moves through the vacuum pumping system is not representative of a leak in the test piece and gives a false reading. This problem is exacerbated when helium is sprayed onto the test piece, thereby increasing the concentration of helium in the ambient environment and increasing the amount of helium that moves through the vacuum pumping system in reverse direction.

Scroll vacuum pumps have been used in helium mass spectrometer leak detectors. The scroll pump may be utilized as the roughing and/or backing pump. A scroll pump configured for backing a high vacuum pump in a mass spectrometer leak detector is disclosed in U.S. Pat. No. 5,542,828, issued Aug. 6, 1996 to Grenci et al.

Conventional scroll vacuum pumps have a relatively low compression ratio for light gases, such as helium. The compression ratio can be increased by reducing clearances and increasing the number of turns of the spiral scroll blades in the scroll vacuum pump. However, this approach substantially increases the cost of the scroll vacuum pump and is not acceptable for low-cost and/or portable applications.

Accordingly, there is a need for improved light gas vacuum pumping systems and methods.

SUMMARY OF THE INVENTION

According to a first aspect of the invention, a vacuum pumping system is provided. The vacuum pumping system comprises a primary vacuum pump having an inlet configured for coupling to a system, and an exhaust, and a secondary vacuum pump having an inlet coupled to the exhaust of the primary vacuum pump. The primary vacuum pump comprises an oil-free, positive displacement vacuum pump having multiple clearance seals between the inlet and the exhaust. The vacuum pumping system may further comprise a valve coupled to the exhaust of the primary vacuum pump and configured to couple the exhaust of the primary vacuum pump to an interpump exhaust in response to a selected condition.

The primary vacuum pump may comprise a scroll vacuum pump, a multi-stage Roots vacuum pump, a multi-stage piston vacuum pump, a screw pump or a hook and claw pump. The secondary vacuum pump may comprise an oil-free diaphragm pump or an oil-free scroll vacuum pump. The valve may comprise a poppet valve configured to open in response to a predetermined pressure differential. In other embodiments, the valve may comprise a controllable valve configured to couple the exhaust of the primary vacuum pump to the interpump exhaust in response to a sensed pressure in the system.

According to a second aspect of the invention, a method is provided for vacuum pumping. The method comprises pumping a system with a primary vacuum pump having an inlet coupled to the system, and an exhaust, and backing the primary vacuum pump with a secondary vacuum pump having an inlet coupled to the exhaust of the primary vacuum pump. The primary vacuum pump comprises an oil-free, positive displacement vacuum pump having multiple clearance seals between the inlet and the exhaust. The method may further comprise coupling the exhaust of the primary vacuum pump to an interpump exhaust in response to a selected condition.

According to a third aspect of the invention, a vacuum pumping system is provided. The vacuum pumping system comprises a primary vacuum pump having an inlet configured for coupling to a system, and an exhaust, the primary vacuum pump comprising an oil-free scroll vacuum pump, a secondary vacuum pump having an inlet coupled to the exhaust of the primary vacuum pump, and a valve coupled to the exhaust of the primary vacuum pump and configured to couple the exhaust of the primary vacuum pump to an interpump exhaust in response to a selected condition.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
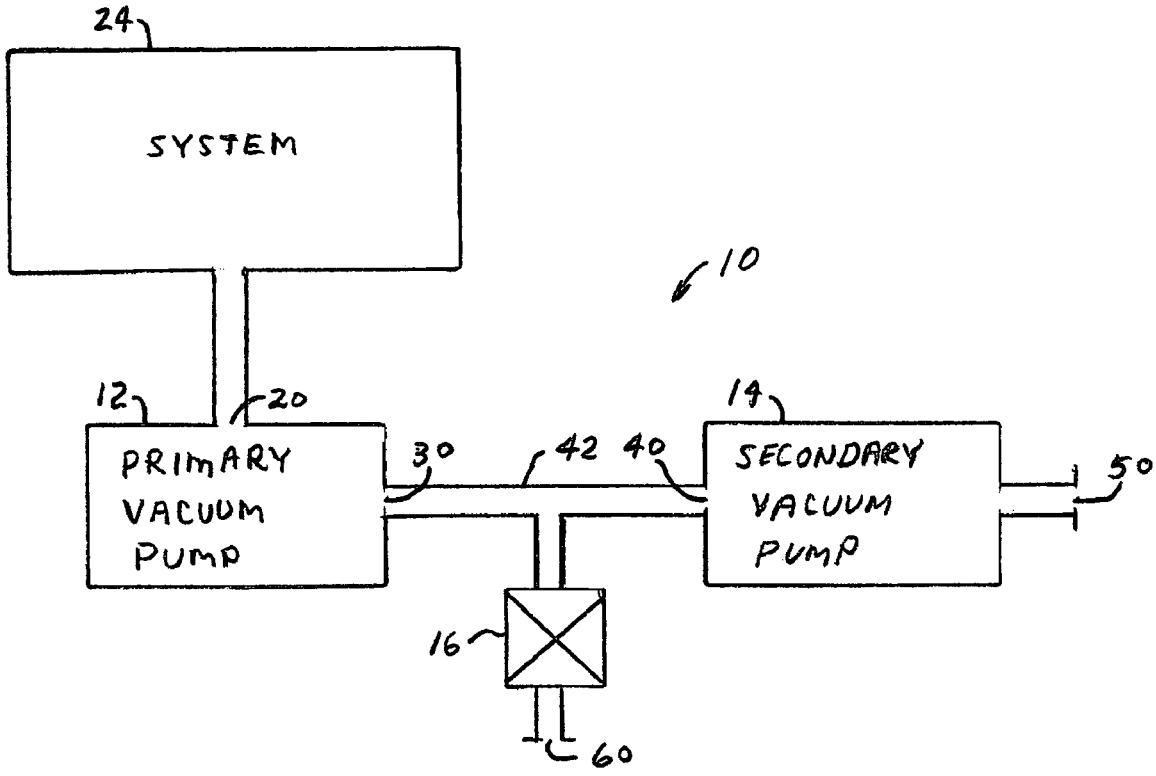
FIG. 1 is a block diagram of a vacuum pumping system in accordance with a first embodiment of the invention.

A block diagram of a vacuum pumping system 10 in accordance with a first embodiment of the invention is shown in FIG. 1. Vacuum pumping system 10 includes a primary vacuum pump 12, a secondary vacuum pump 14 and may include a valve 16. The primary vacuum pump 12 has an inlet 20 coupled to a system 24 to be pumped. Primary vacuum pump 12 further includes an exhaust 30. Secondary vacuum pump 14 has an inlet 40 coupled to exhaust 30 of primary vacuum pump 12 through a conduit 42. Secondary vacuum pump 14 further includes an exhaust 50. Optional valve 16 is coupled to conduit 42 between exhaust 30 of primary vacuum pump 12 and inlet 40 of secondary vacuum pump 14. When valve 16 is open, exhaust 30 of primary vacuum pump 12 is coupled to an interpump exhaust 60, and secondary vacuum pump 14 is effectively bypassed.

Primary vacuum pump 12 may be an oil-free, or dry, positive displacement vacuum pump having multiple clearance seals between inlet 20 and exhaust 30. An oil-free vacuum pump is one that does not utilize oil in its working volume. It will be understood that parts of the vacuum pump which are isolated from the working volume, such as the motor, gears or bearings, may utilize oil. A scroll vacuum pump is an example of a vacuum pump having multiple clearance seals between the inlet and the exhaust. A suitable scroll vacuum pump is the Varian SH100. Other types of oil-free vacuum pumps having multiple clearance seals between inlets and exhausts include oil-free multi-stage Roots pumps, oil-free multi-stage piston pumps, oil-free screw pumps and oil-free hook and claw pumps. All these primary pumps are oil-free, positive displacement devices. These pumps incorporate tight running clearances to create multiple gas pockets separated by respective multiple clearance seals between inlet and exhaust. Commercially available examples of these pumps include: (1) screw pump—Kashiyama HC-60; (2) Roots pump—Alcatel ACP 28; (3) hook and claw pump—Edwards QDP40; and (4) piston pump—Pfeiffer XtraDry 150-2.

A scroll vacuum pump includes stationary and orbiting scroll elements, and a drive mechanism. The stationary and orbiting scroll elements each include a scroll plate and a spiral scroll blade extending from the scroll plate. The scroll blades are intermeshed together to define interblade pockets. The drive mechanism produces orbiting motion of the orbiting scroll element relative to the stationary scroll element so as to cause the interblade pockets to move toward the pump exhaust. Tip seals located in grooves at the tips of the scroll blades provide sealing between the scroll elements. The interblade pockets may be viewed as multiple stages of the scroll pump, and the tip seals may be viewed as providing clearance seals between adjacent interblade pockets. The scroll vacuum pump thus has multiple clearance seals between its inlet and its outlet.

Secondary vacuum pump 14 may be a relatively inexpensive, oil-free vacuum pump. One example is an oil-free diaphragm vacuum pump. A suitable diaphragm vacuum pump is a KNF N84.3. In other embodiments, secondary vacuum pump 14 may be an oil-free scroll vacuum pump. In embodiments where valve 16 is utilized, secondary vacuum pump 14 can have a smaller pumping capacity than primary vacuum pump 12, since secondary vacuum pump 14 is bypassed until a relatively low mass flow rate is required.

In one embodiment, valve 16 is a spring-loaded poppet valve which exhausts through interpump exhaust 60 to atmosphere. Valve 16 may be configured to automatically open when the pressure at exhaust 30 of primary vacuum pump 12 exceeds atmospheric pressure and to automatically close when the pressure at exhaust 30 drops below atmospheric pressure. Thus, valve 16 is open during periods of high mass flow only. The mass throughput of the two vacuum pumps together is only dependent on the capacity of the primary vacuum pump, and not on the capacity of the secondary vacuum pump. When system 24 is evacuated from atmosphere, the bulk of the gas is pumped through the primary vacuum pump 12 and is exhausted through valve 16 to atmosphere. As the mass flow rate decreases, the secondary vacuum pump 14 evacuates the conduit 42 to a sub-atmospheric level, causing valve 16 to seal. The pressure differential across valve 16 keeps it closed. From then on, primary vacuum pump 12 and secondary vacuum pump 14 are connected in series for pumping system 24. The exhaust region of primary vacuum pump 12 is subsequently pumped down to a pressure level approaching the base pressure of secondary vacuum pump 14. In some cases where the gas is not vented to atmosphere, exhaust 50 and interpump exhaust 60 may be connected to a common exhaust conduit (not shown).

Vacuum pumping system 10 is particularly useful for pumping systems which require a high compression ratio for light gases, such as helium and hydrogen. Accordingly, system 24 may be a helium mass spectrometer leak detector. However, vacuum pumping system 10 is not limited in this respect and may be utilized in any system requiring a high compression ratio for light gases, and may be utilized in other systems as well.

With the oil-free primary vacuum pump 12 and oil-free secondary vacuum pump 14 operating in series, the light gas compression ratio is much greater than with either pump alone and is substantially greater than the product of the compression ratios of the individual pumps. Reducing the exhaust pressure of the primary vacuum pump to a low level dramatically increases this pump's ability to compress light gases. This effect can be measured in a helium mass spectrometer leak detector, where the helium background level detectable by the leak detector falls to an extremely low level. For example, use of a 100 liters per minute (lpm) scroll vacuum pump alone results in a displayed helium background of about $5\times10^{-8}$ sccs (standard cubic centimeters per second), in an ambient 1000 parts per million helium environment. When a 5 lpm diaphragm vacuum pump is placed in series with this scroll vacuum pump, the detected helium background level falls by a factor of more than 1000. The stand-alone base pressures of the scroll pump and diaphragm pump were 10 milliTorr and 4 Torr, respectively. If the pumping efficiency of the primary vacuum pump remained constant, then the overall compression ratio across the two pumps in series would increase by a factor of only 190 (760/4) in the above example. However, because the helium background level drops by a factor of more than 1000, the helium pumping efficiency of the primary vacuum pump must have increased significantly.

Figure 2:
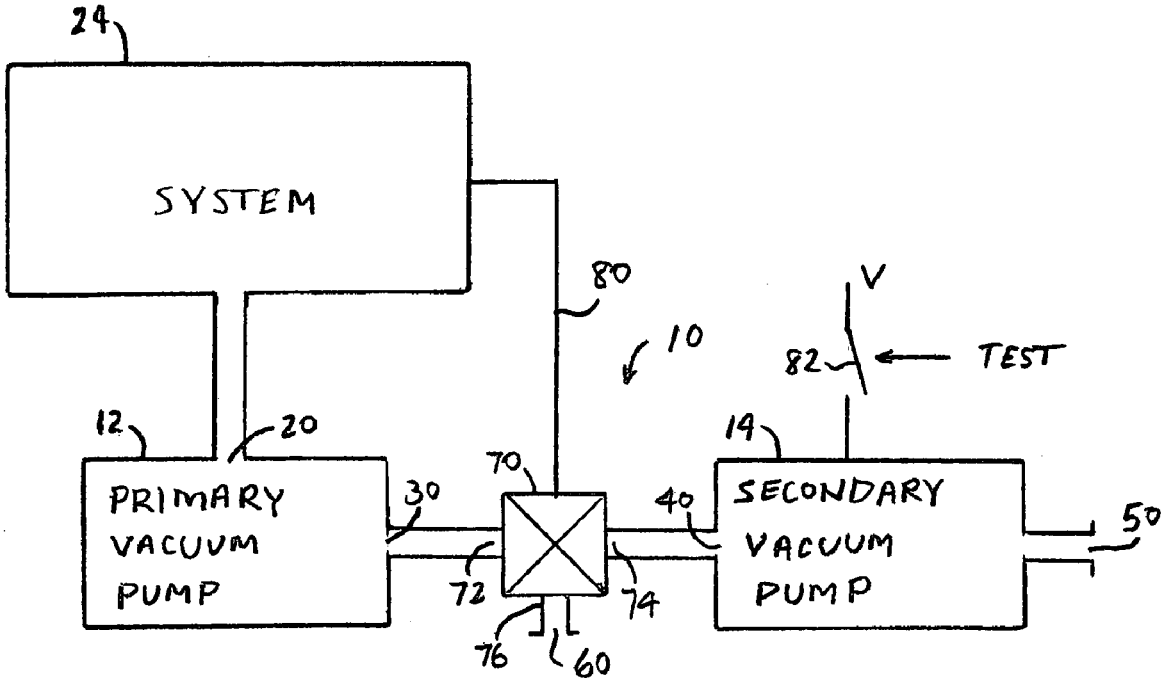
FIG. 2 is a block diagram of a vacuum pumping system in accordance with a second embodiment of the invention.

A block diagram of vacuum pumping system 10 in accordance with a second embodiment of the invention is shown in FIG. 2. Like elements in FIGS. 1 and 2 have the same reference numerals. In the embodiment of FIG. 2, valve 70 has an inlet 72 connected to exhaust 30 of primary vacuum pump 12. A first outlet 74 of valve 70 is connected to inlet 40 of secondary vacuum pump 14, and a second outlet 76 of valve 70 serves as interpump exhaust 60. Valve 70 maybe a two-way valve that is electronically or pneumatically controlled. Valve 70 may have a first state in which inlet 72 is connected to first outlet 74 and a second state in which inlet 72 is connected to second outlet 76. The state of valve 70 is controlled by a control signal on a line 80. In the embodiment of FIG. 2, valve 70 is controlled by a signal representative of pressure in system 24. Thus, for example, valve 70 may connect inlet 72 to second outlet 76 when the pressure in system 24 is above a selected level and may connect inlet 72 to first outlet 74 when the pressure in system 24 is below the selected level. In other embodiments, valve 70 may be controlled by a different condition, such as for example the pressure at exhaust 30 of primary vacuum pump 12.

In the embodiment of FIG. 2 secondary vacuum pump 14 may be enabled when a test, such as a leak test, is being performed and may be disabled when a test is not being performed. By disabling secondary vacuum pump 14 when a test is not being performed, power consumption can be reduced. As shown, a controllable switch 82 is connected in series with power supply V for secondary vacuum pump 14. A test signal closes switch 82 when a test is being performed and opens switch 82 when a test is not being performed. It will be understood that that switch 82 may be closed in advance of a test to provide sufficient time for pumping residual light gases from system 24. It will further be understood that different techniques may be utilized for enabling and disabling secondary vacuum pump 14, within the scope of the invention.

Figure 3:
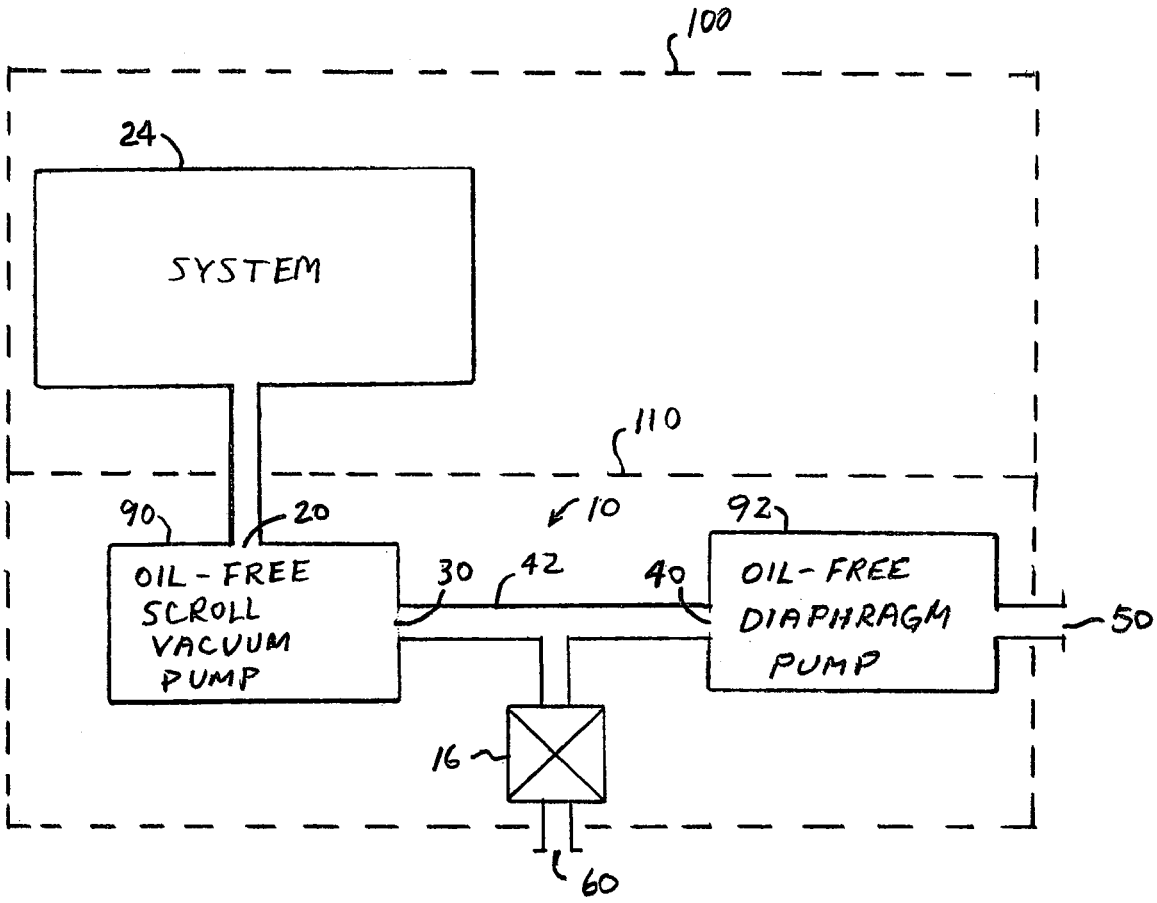
FIG. 3 is a block diagram of a vacuum pumping system in accordance with a third embodiment of the invention.

A block diagram of vacuum pumping system 10 in accordance with a third embodiment of the invention is shown in FIG. 3. Like elements in FIGS. 1 and 3 have the same reference numerals. In the embodiment of FIG. 3, the primary vacuum pump is an oil-free scroll vacuum pump 90, and the secondary vacuum pump is an oil-free diaphragm pump 92. In one specific implementation, scroll vacuum pump 90 is a small oil-free scroll pump with a 50 lpm speed and a 500 millitorr base pressure and diaphragm pump 92 is a 5 lpm KNF N84.3.

In addition, FIG. 3 illustrates a packaging technique that may be utilized in accordance with embodiments of the invention. In one embodiment, system 24, scroll vacuum pump 90 or other primary vacuum pump, diaphragm pump 92 or other secondary vacuum pump and valve 16 or other valve may be enclosed within a single package 100, represented schematically in FIG. 3 by dashed lines. Such a packaging configuration is useful for compact and/or portable systems. By way of example, system 24 may be a helium mass spectrometer leak detector. In other embodiments, scroll vacuum pump 90 or other primary vacuum pump, diaphragm pump 92 or other secondary vacuum pump and valve 16 or other valve may be enclosed within a package 110, shown schematically in FIG. 3 by dashed lines.

Having thus described various illustrative non-limiting embodiments, and aspects thereof, modifications and alterations will be apparent to those who have skill in the art. Such modifications and alterations are intended to be included in this disclosure, which is for the purpose of illustration and explanation, and not intended to define the limits of the invention. The scope of the invention should be determined from proper construction of the appended claims and equivalents thereof.

What is claimed is:

1. A leak detector system comprising:

a helium mass spectrometer leak detector;

a primary vacuum pump having an inlet in gas communication with the helium mass spectrometer leak detector, and an exhaust, the primary vacuum pump comprising an oil-free, positive displacement vacuum pump selected from the group consisting of a scroll vacuum pump, a multi-stage roots vacuum pump, a multi-stage piston vacuum pump, a screw vacuum pump and a hook and claw vacuum pump; and a secondary vacuum pump having an inlet coupled to the exhaust of the primary vacuum pump, the primary vacuum pump having a primary vacuum pump compression ratio when operated alone and the secondary vacuum pump having a secondary vacuum pump compression ratio when operated alone, a light gas compression ratio of the primary vacuum pump and the secondary vacuum pump operating together being greater than a product of either the primary vacuum pump compression ratio or the secondary vacuum pump compression ratio.

2. A leak detector system as defined in claim 1, wherein the secondary vacuum pump comprises an oil-free diaphragm vacuum pump.

3. A leak detector system as defined in claim 1, wherein the secondary vacuum pump comprises an oil-free scroll vacuum pump.

4. A leak detector system as defined in claim 1, further comprising a valve coupled to the exhaust of the primary vacuum pump and configured to provide an interpump exhaust in response to a selected condition.

5. A leak detector system as defined in claim 4, wherein the secondary vacuum pump has a lower pumping capacity than the primary vacuum pump.

6. A leak detector system as defined in claim 4, wherein the valve comprises a poppet valve configured to open automatically in response to a predetermined pressure differential across the valve.

7. A leak detector system as defined in claim 4, wherein the valve comprises a controllable valve configured to couple the exhaust of the primary vacuum pump to the interpump exhaust in response to a sensed pressure level in the system.

8. A leak detector system as defined in claim 1, wherein the primary vacuum pump and the secondary vacuum pump are packaged in a single housing.

9. A leak detector system as defined in claim 1, wherein the primary vacuum pump and the secondary vacuum pump are configured to provide a high compression ratio for light gases.

10. A method for vacuum pumping a leak detector comprising:

providing a helium mass spectrometer leak detector;

pumping the helium mass spectrometer leak detector with a primary vacuum pump having an inlet in gas communication with the helium mass spectrometer leak detector, and an exhaust, the primary vacuum pump comprising an oil-free, positive displacement vacuum pump selected from the group consisting of a scroll vacuum pump, a multi-stage roots vacuum pump, a multi-stage piston vacuum pump, a screw vacuum pump and a hook claw vacuum pump; and backing the primary vacuum pump with a secondary vacuum pump having an inlet coupled to the exhaust of the primary vacuum pump, the primary vacuum pump having a primary vacuum pump compression ratio when operated alone and the secondary vacuum pump having a secondary vacuum pump compression ratio when operated alone, a light gas compression ratio of the primary vacuum pump and the secondary vacuum pump operating together being greater than a product of either the primary vacuum pump compression ratio or the secondary vacuum pump compression ratio.

11. A method as defined in claim 10, further comprising coupling the exhaust of the primary vacuum pump through a valve to an interpump exhaust in response to a selected condition.

12. A method as defined in claim 11, wherein pumping the system with a primary vacuum pump comprises pumping the system with an oil-free scroll vacuum pump and wherein backing the primary vacuum pump with a secondary vacuum pump comprises backing the primary vacuum pump with an oil-free diaphragm pump.

13. A leak detector system comprising:

a helium mass spectrometer leak detector;

a primary vacuum pump having an inlet in gas communication with the helium mass spectrometer leak detector, and an exhaust, the primary vacuum pump comprising an oil-free scroll vacuum pump; and a secondary vacuum pump having an inlet coupled to the exhaust of the primary vacuum pump, the primary vacuum pump having a primary vacuum pump compression ratio when operated alone and the secondary vacuum pump having a secondary vacuum pump compression ratio when operated alone, a light gas compression ratio of the primary vacuum pump and the secondary vacuum pump operating together being greater than a product of either the primary vacuum pump compression ratio or the secondary vacuum pump compression ratio.

14. A leak detector system as defined in claim 13, wherein the secondary vacuum pump comprises an oil-free diaphragm pump.

15. A leak detector system as defined in claim 14, wherein the valve comprises a poppet valve configured to open automatically in response to a predetermined pressure differential across the valve.

16. A leak detector system as defined in claim 13, further comprising a valve coupled to the exhaust of the primary vacuum pump and configured to provide an interpump exhaust in response to a selected condition.

* * * * *

UNITED STATES PATENT AND TRADEMARK OFFICE

CERTIFICATE OF CORRECTION

PATENT NO. : 7,189,066 B2
APPLICATION NO. : 10/845991
DATED : March 13, 2007
INVENTOR(S) : Anthony G. Lipert It is certified that error appears in the above-identified patent and that said Letters Patent is hereby corrected as shown below:

Please correct column 8, lines 6, 9 and 13 as follows:

Column 8, Line 6:

14. A leak detector system as defined in claim 13, further comprising a valve coupled to the exhaust of the primary vacuum pump and configured to provide an interpump exhaust in response to a selected condition.

Column 8, Line 9:

15. A leak detector system as defined in claim 13, wherein the secondary vacuum pump comprises an oil-free diaphragm pump.

Column 8, Line 13:

16. A leak detector system as defined in claim 15, wherein the valve comprises a poppet valve configured to open automatically in response to a predetermined pressure differential across the valve.

Signed and Sealed this

Third Day of June, 2008

JON W. DUDAS
*Director of the United States Patent and Trademark Office*